US009844688B2

(12) United States Patent
Chan et al.

(10) Patent No.: US 9,844,688 B2
(45) Date of Patent: Dec. 19, 2017

(54) BREATHING AIRBAG DEVICE

(71) Applicant: Shunon Chan, Hongkong (CN)

(72) Inventors: Shunon Chan, Hongkong (CN); Shamman Chan, Hongkong (CN)

(73) Assignee: Lili He, Shenzhen, Guangdong Province (CN)

( * ) Notice: Subject to any disclaimer, the term of this patent is extended or adjusted under 35 U.S.C. 154(b) by 917 days.

(21) Appl. No.: 14/352,458

(22) PCT Filed: Mar. 11, 2014

(86) PCT No.: PCT/CN2014/073242

§ 371 (c)(1),
(2) Date: Apr. 17, 2014

(87) PCT Pub. No.: WO2014/154090

PCT Pub. Date: Oct. 2, 2014

(65) Prior Publication Data

US 2014/0290661 A1 Oct. 2, 2014

(30) Foreign Application Priority Data

Mar. 27, 2013 (CN) ..... 2013 1 010681

(51) Int. Cl.
*A62B 23/02* (2006.01)
*A62B 18/02* (2006.01)

(52) U.S. Cl.
CPC ..... *A62B 23/025* (2013.01); *A62B 18/025* (2013.01)

(58) Field of Classification Search
CPC ..... A62B 23/025; A62B 18/025; A41D 13/11; A41D 13/1146; A61D 7/04; A61M 15/08; A61M 15/085
See application file for complete search history.

(56) References Cited

U.S. PATENT DOCUMENTS 2,153,437 A * 4/1939 Schwartz ..... A62B 23/02 128/206.16
2,845,927 A * 8/1958 Hill ..... A62B 23/025 128/206.17
4,098,270 A * 7/1978 Dolby ..... A62B 18/02 128/206.12
5,603,317 A * 2/1997 Farmer ..... A41D 13/1146 128/205.27
7,658,189 B2 * 2/2010 Davidson ..... A61M 16/06 128/205.25

* cited by examiner

*Primary Examiner* — (Jackie) Tan-Uyen T Ho
*Assistant Examiner* — Jonathan Paciorek

(57) ABSTRACT

A breathing airbag device includes a filter airbag, an inner holding stand, a nose holder, a mouth holder, and two elastic straps, wherein the filter airbag is adapted for interacting with and filtering the outside air, the inner holding stand is adapted for supporting and fixing the nose holder and mouth holder, the nose holder is adapted for fittingly supporting the human nose, the mouth holder is adapted for fittingly supporting the human mouth, the inner holding stand is located on the filter airbag, the nose holder and the mouth holder are located on the inner holding stand, and two ends of each of the elastic straps are fixed to an edge position of the nose holder. The present invention has some advantages of good tightness, simple structure and low manufacturing cost.

4 Claims, 4 Drawing Sheets

BREATHING AIRBAG DEVICE

BACKGROUND OF THE PRESENT INVENTION

Field of Invention

The present invention relates to a breathing airbag device.

Description of Related Arts

With the advancement of the industrial technology, the production and manufacturing techniques of the people's living daily necessities and industrial goods have been widely developed. As a daily necessities, the type and purpose of the breathing filter device has been extensively developed. The disposable mask is used to prevent the respiratory infection and dust in general, although this mask is cheap, due to its material and structural issues, the role of avoiding the respiratory infection is limited, the main reason is poor tightness to the nose and the mouth. The traditional high-end masks, such as gas masks, oxygen mask, etc., due to poor tightness to the nose and the mouth, have the security issues. Moreover, the traditional high-end mask has more complex structure and higher manufacturing cost.

SUMMARY OF THE PRESENT INVENTION

An object of the present invention is to provide a breathing airbag device for resolving the technical problems of the prior art that the breathing filtering device has poor tightness, complex structure and high manufacturing cost. The specific technical solution of the present invention is as follows.

The present invention provides a breathing airbag device which comprises a filter airbag, an inner holding stand, a nose holder, a mouth holder, and two elastic straps, wherein the filter airbag is adapted for interacting with and filtering the outside air, the inner holding stand is adapted for supporting and fixing the nose holder and mouth holder, the nose holder is adapted for fittingly supporting the human nose, the mouth holder is adapted for fittingly supporting the human mouth, the inner holding stand is located on the filter airbag, the nose holder and the mouth holder are located on the inner holding stand, and two ends of each of the elastic straps are fixed to an edge position of the nose holder.

Furthermore, the breathing airbag device comprises a naval breathing rubber sleeve connected with the filter airbag via the nose holder for enhancing a comfort of a support of a human nose.

Furthermore, the breathing airbag device comprises a mouth breathing rubber sleeve connected with the filter airbag via the mouth holder for enhancing a comfort of a support of a human mouth.

Furthermore, the naval breathing rubber sleeve and the mouth breathing rubber sleeve are soft rubber sleeves or thin silicone sleeves.

Furthermore, the filter airbag comprises an outer layer and an inner layer, wherein the outer layer is adapted for coating and protecting the inner layer, an airbag is formed between the outer layer and the inner layer, and a naval breathing opening and a mouth breathing opening, which are adapted for connecting with the airbag, are provided on each of the outer layer and the inner layer.

Furthermore, the inner holding stand comprises a first stand portion and a second stand portion, wherein one end of the first stand portion is inclinedly connected with one end of the second stand portion, the other end of the first stand portion and the other end of the second stand portion are inclinedly connected with the outer layer of the filter airbag, a first convex hole is provided on the first stand portion, a second convex hole is provided on the second stand portion, the first convex hole correspondingly contacts with the naval breathing opening of the filter airbag, and the second convex hole correspondingly contacts with the mouth breathing opening of the filter airbag.

Furthermore, the nose holder comprises a nose holding body part, a nose holding connecting part and two nose holding undertaking parts, wherein the two nose holding undertaking parts are respectively located at two sides of the nose holding body part, and the nose holding body part is fixed with the two nose holding undertaking parts via the nose holding connecting part, a nose holding convex hole is provided in the middle of the nose holding body part for fittingly fixing the first convex hole of the inner holding stand.

Furthermore, the mouth holder comprises a mouth holding body part, and two mouth holding connecting parts respectively located at two sides of the mouth holding body part, wherein a mouth holding convex hole is provided in the middle of the mouth holding body part for fittingly fixing the second convex hole of the inner holding stand.

Furthermore, the breathing airbag device further comprises a flexible fixed rope for flexiblely fixing the mouth holder on the nose holder.

Furthermore, the outer layer and the inner layer are made of non-woven fabric, and the nose holder and the mouth holder are made of soft rubber material.

Compared with the prior art, the main beneficial effects of the breathing airbag device of the present invention are that: the filter airbag of the breathing airbag device provided by the present invention comprises two non-woven fabric layers, namely, the outer layer and the inner layer, which can better filter the air, the breathing airbag device of the present invention further comprises the nose holder and the mouth holder capable of better fittingly supporting the human nose and the human mouth, respectively, and has the good tightness to the human nose and the human mouth. Furthermore, the nose holder and the mouth holder of the breathing airbag device of the present invention are flexiblely connected with each other. The present invention can adjust the relative position of the nose holder and the mouth holder as required and has strong applicability. Furthermore, the breathing airbag device provided by the present invention further has the advantages of simple structure and low manufacturing cost.

DETAILED DESCRIPTION OF THE PREFERRED EMBODIMENT

To make the objects, technical solutions and advantages of the present invention will be more clearly understood, the accompanying drawings and the following embodiments of the present invention will be described in detail. It should be understood that the specific embodiments described herein are merely to illustrate the invention and are not intended to limit the present invention.

Embodiment 1

Figure 1:
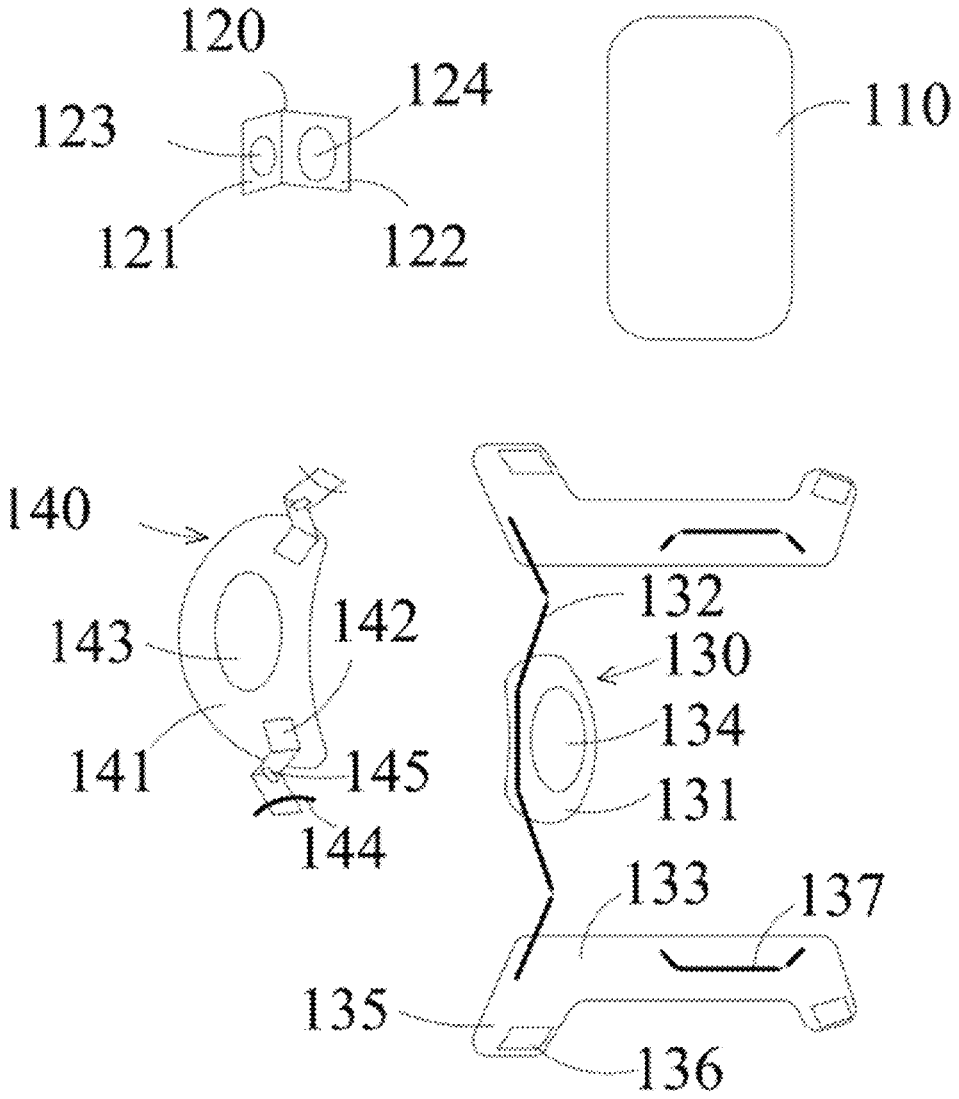
FIG. 1 is an exploded view of a breathing airbag device according to a first embodiment of the present invention.
Figure 2:
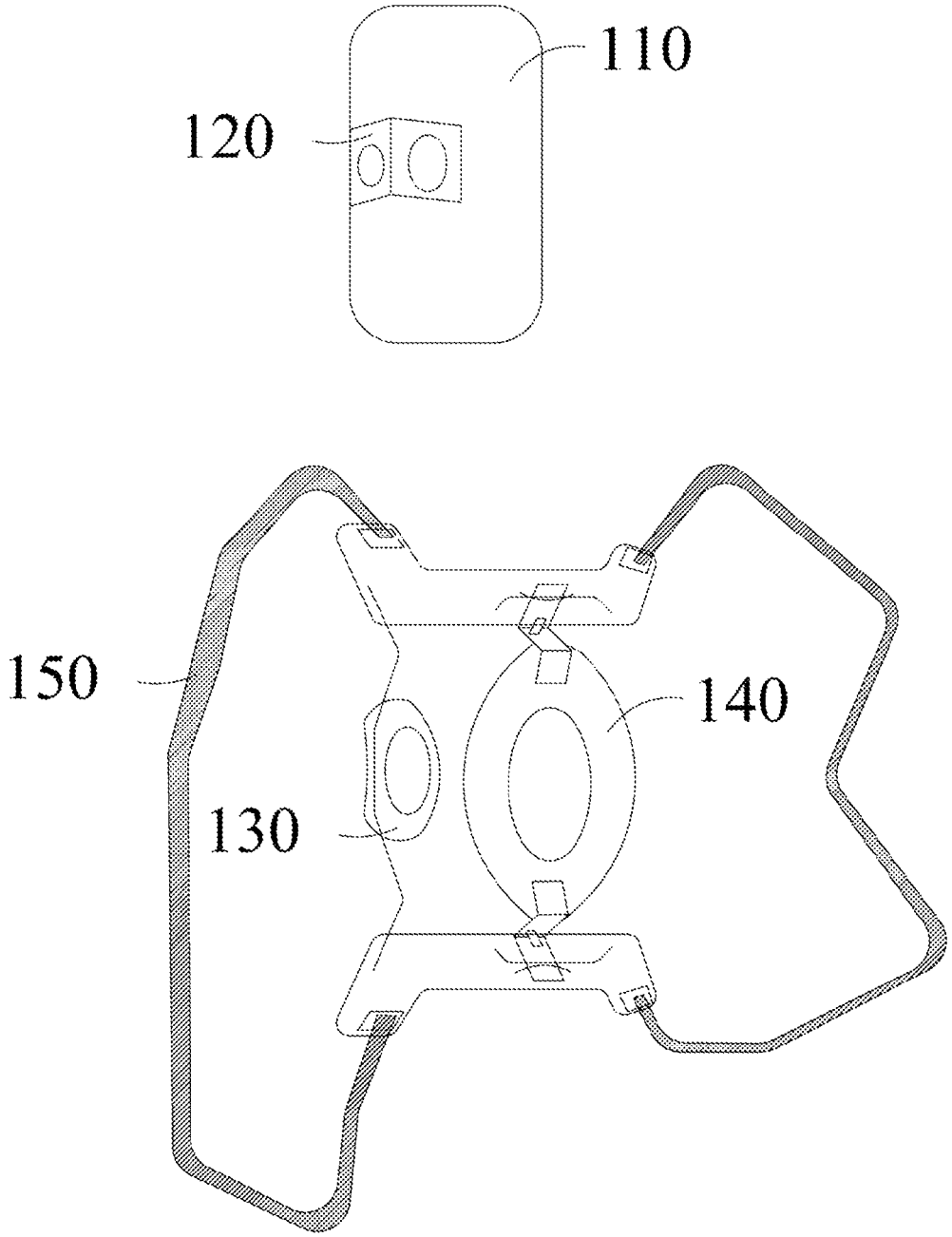
FIG. 2 is a partially assembling sectional view of the breathing airbag device according to the first embodiment of the present invention.
Figure 3:
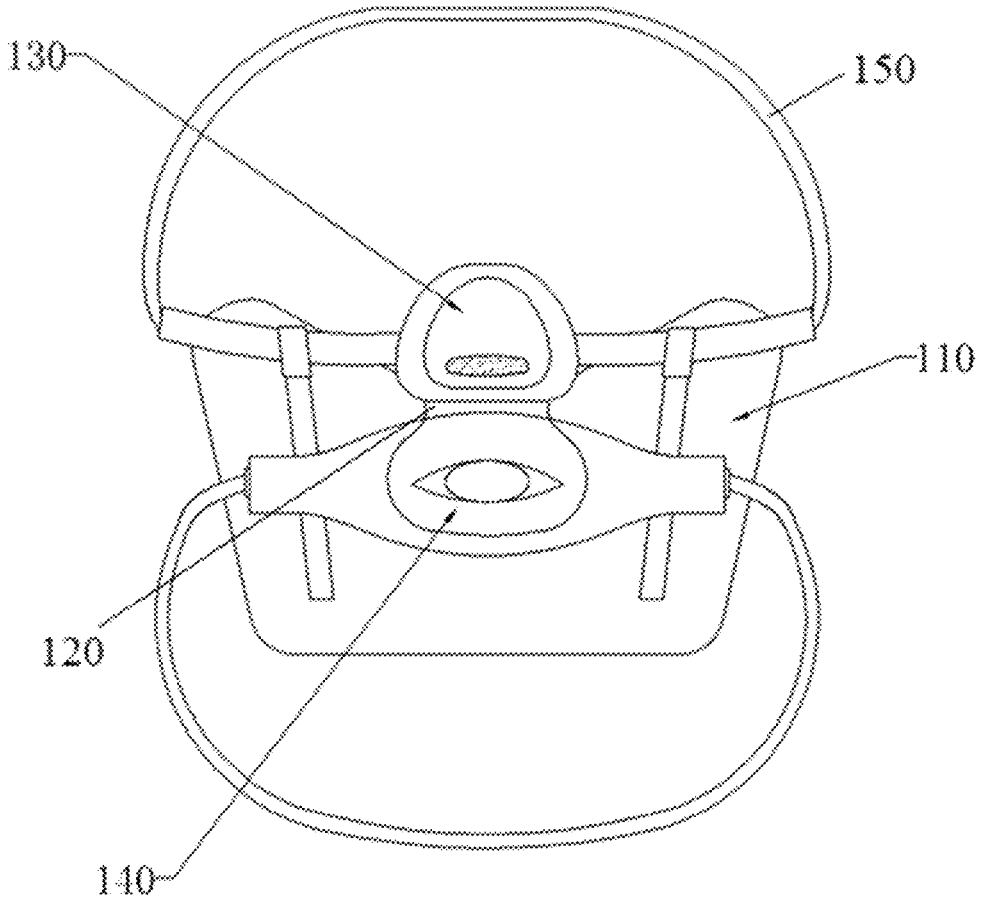
FIG. 3 is an overall structural diagram of the breathing airbag device of the present invention.
Figure 4:
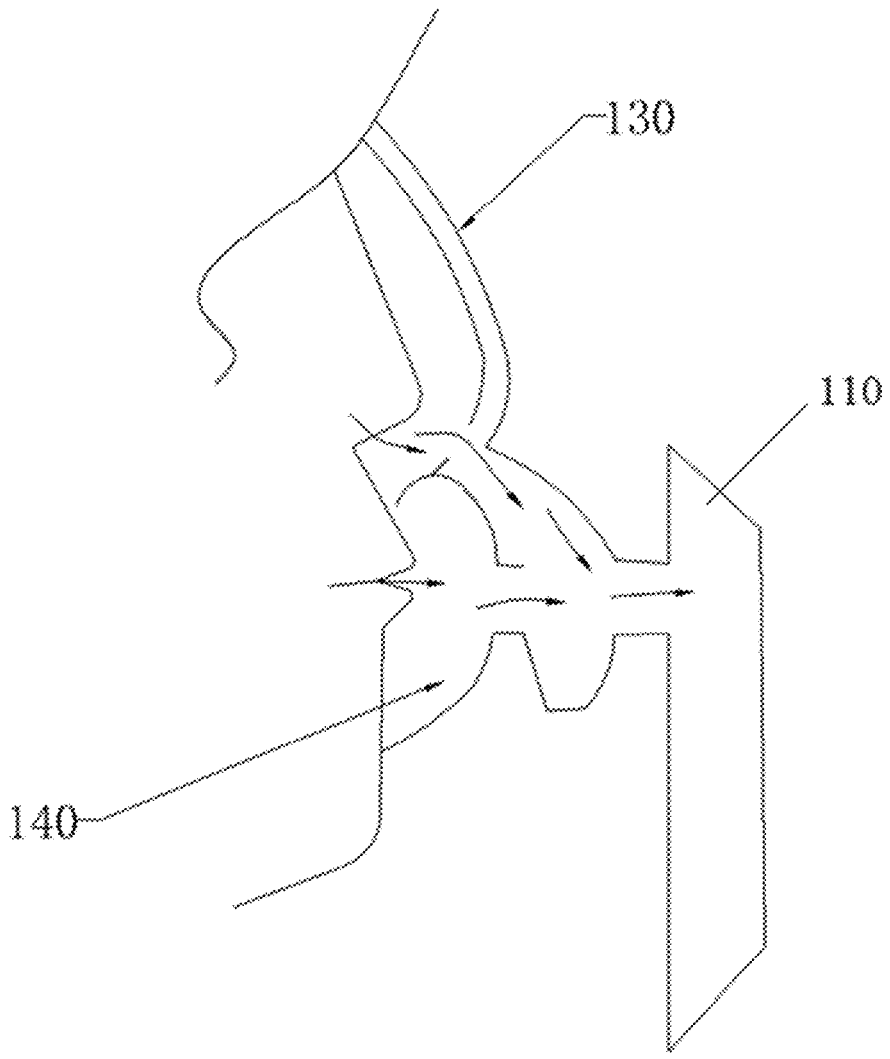
FIG. 4 shows that the breathing airbag device of the present invention contacts with a human face.

Referring to FIGS. 1 and 2 of the drawings, the present invention provides a breathing airbag device which comprises a filter airbag 110, an inner holding stand 120, a nose holder 130, a mouth holder 140, two elastic straps 150, a flexible fixed rope (not shown in the drawings), a naval breathing rubber sleeve (not shown in the drawings), and a mouth breathing rubber sleeve (not shown in the drawings). The inner holding stand 120 is located on the filter airbag 110, and the nose holder 130 and the mouth holder 140 are located on the inner holding stand 120. The flexible fixed rope is adapted for flexiblely fixing the mouth holder 140 on the nose holder 130. Two ends of the two elastic straps 150 are respectively fixed to four edge positions of the nose holder 130. The naval breathing rubber sleeve is connected with the filter airbag 110 via the nose holder 130 and is adapted for enhancing the comfort of the support of the human nose. The mouth breathing rubber sleeve is connected with the filter airbag 110 via the mouth holder 140 and is adapted for enhancing the comfort of the support of the human mouth. The naval breathing rubber sleeve and the mouth breathing rubber sleeve are soft rubber sleeves or thin silicone sleeves.

The filter airbag 110, adapted for interacting with and filtering the outside air, comprises an outer layer (not shown in the drawings) and an inner layer (not shown in the drawings). The outer layer is adapted for coating and protecting the inner layer, the airbag is formed between the outer layer and the inner layer, the naval breathing opening (not shown in the drawings) and the mouth breathing opening (not shown in the drawings), which are adapted for connecting with the airbag, are provided on each of the outer layer and the inner layer. A docking slot, adapted for connecting with the inner holding stand 120, is provided on the outer layer. A rubber pad or a sponge pad is provided within the inner layer. The outer layer and the inner layer are made of non-woven fabric.

The inner holding stand 120, adapted for supporting and fixing the nose holder 130 and mouth holder 140, comprises a first stand portion 121 and a second stand portion 122. One end of the first stand portion 121 is inclinedly connected with one end of the second stand portion 122. The other end of the first stand portion 121 and the other end of the second stand portion 122 are inclinedly connected with the outer layer of the filter airbag 110. A dip angle defined by one end of the first stand portion 121 inclinedly connected with one end of the second stand portion 122 is an obtuse angle. A first convex hole 123 is provided on the first stand portion 121, and a second convex hole 124 is provided on the second stand portion 122. The first convex hole 123 protrudes towards the direction which connects with the nose holder 130. The second convex hole 124 protrudes towards the direction which connects with the mouth holder 140. The first convex hole 123 correspondingly contacts with the naval breathing opening of the filter airbag 110, and the second convex hole 124 correspondingly contacts with the mouth breathing opening of the filter airbag 110. An inner diameter of the first convex hole 123 is smaller than that of the second convex hole 124. The inner holding stand 120 is made of plastic or metal.

The nose holder 130 is adapted for fittingly supporting the human nose and circulating the air between the human nose and the filter airbag 110. The nose holder 130 comprises a nose holding body part 131, a nose holding connecting part 132 and two nose holding undertaking parts 133, wherein the two nose holding undertaking parts 133 are respectively located at two sides of the nose holding body part 131, and the nose holding body part 131 is fixed with the two nose holding undertaking parts 133 via the nose holding connecting part 132. The nose holding body part 131 is oval, and a nose holding convex hole 134 is provided in the middle thereof. The nose holding convex hole 134 is oval, protrudes towards the direction of the top surface of the nose holding body part 131 and is adapted for fittingly fixing the first convex hole 123 of the inner holding stand 120. The nose holding connecting part 132 is arched, its center position is fixed to one end where the short axis of the nose holding convex hole is located, its two ends are respectively fixed to the top ends of the two nose holding undertaking parts 133. The two nose holding undertaking parts 133 are respectively correspondingly located at two sides of the nose holding body part 131. Two convex legs 135 are respectively located at a top end and a bottom end of each of the two nose holding undertaking parts 133, an elastic strap fixing hole 136 is provided on every convex leg, an elastic strap 150 is fixed to the two elastic strap fixing holes 136 at the top end of the two nose holding undertaking parts 133, and an elastic strap 150 is fixed to the two elastic strap fixing holes 136 at the bottom end of the two nose holding undertaking parts 133. A mouth holding fixing hole 137, adapted for fittingly fixing the mouth holder 140, is provided in the middle of each of the two nose holding undertaking parts 133. The nose holder 130 is made of soft rubber material. The naval breathing rubber sleeve penetrates through the nose holding convex hole 134 of the nose holder 130 and the first convex hole 123 of the inner holding stand 120, and connects with the filter airbag 110 for achieving the semi-floating connection.

The mouth holder 140 is adapted for fittingly supporting the human mouth and circulating the air between the human mouth and the filter airbag 110. The mouth holder 140 comprises a mouth holding body part 141, and two mouth holding connecting parts 142 respectively located at two sides of the mouth holding body part 141. The mouth holding body part 141 is oval, and a mouth holding convex hole 143 is provided in the middle thereof. The mouth holding convex hole 143 is oval, protrudes towards the direction of the top surface of the mouth holding body part 141 and is adapted for fittingly fixing the second convex hole 124 of the inner holding stand 120. The two mouth holding connecting parts 142 are respectively located at two ends of the top surface at the direction of the long axis of the mouth holding body part 141. Each of the two mouth holding connecting parts 142 has the ladder bending structure, one end thereof extends outwardly, the other end thereof is located at the mouth holding body part 141. A curved rod 144 and a lug 145 are located at the end of the mouth holding connecting part 142 extending outwardly. The curved rod 144 is adapted for fittingly fixing the mouth holding fixing hole 137 of the nose holder 130. The curved rod 144 is located at the top surface at the extending outwardly end of every mouth holding connecting part 142 along a direction perpendicularly to the extending outwardly direction of every mouth holding connecting part 142. The lug 145 is located at the top surface at the extending outwardly end of every mouth holding connecting part 142 along a direction opposite to the extending outwardly direction of every mouth holding connecting part 142. The mouth holder 140 is made of soft rubber material. The mouth breathing rubber sleeve penetrates through the mouth holding convex hole 143 of the mouth holder 140 and the first convex hole 123 of the inner holding stand 120, and connects with the filter airbag 110 for achieving the semi-floating connection. The mouth breathing rubber sleeve is the soft rubber sleeve or the thin silicone sleeve. The flexible fixed rope bypasses the edge of the mouth holding convex hole 143 of the mouth holding body part 141, and respectively winds the curved rod 144 of one mouth holding connecting part 142 and the mouth holding fixing hole 137 of one nose holding undertaking part 133 located at two sides of the mouth holding body part 141, thereby achieving the damping mobile of the mouth holder 140 relatively to the nose holder 130 along the vertical direction.

Embodiment 2

The breathing airbag device provided by the present invention and the breathing airbag device of the embodiment 1 is basically the same, and the main difference therebetween is that the inner holding stand is bonded to the airbag.

Embodiment 3

The breathing airbag device provided by the present invention and the breathing airbag device of the embodiment 1 is basically the same, and the main difference therebetween is that the amount of the elastic straps is one or more.

It should be noted that the above embodiments are only used to illustrate the technical solutions of the present invention and are not limited, although the preferred embodiments with reference to the present invention has been described in detail, those skilled in the art should appreciate that the techniques of the present invention can be modified or replaced with equivalents, without departing from the spirit and scope of the aspects of the present invention, which should be covered by the scope claimed by the present invention.

What is claimed is:

1. A breathing airbag device, comprising: a filter airbag, an inner holding stand, a nose holder, a mouth holder and two elastic straps, wherein:

the inner holding stand is located on the filter airbag, the nose holder and the mouth holder are located on the inner holding stand, two ends of the two elastic straps are respectively fixed to four edge positions of the nose holder;

the filter airbag is adapted for interacting with and filtering outside air;

the inner holding stand, adapted for supporting and fixing the nose holder and the mouth holder, comprises a first stand portion and a second stand portion, a first end of the first stand portion is inclinedly connected with a first end of the second stand portion, both a second end of the first stand portion and a second end of the second stand portion are inclinedly connected with the filter airbag, an angle defined by the first end of the first stand portion inclinedly connected with the first end of the second stand portion is an obtuse angle, a first convex hole is provided on the first stand portion, a second convex hole is provided on the second stand portion, the first convex hole protrudes towards a direction which connects the nose holder therewith, the second convex hole protrudes towards a direction which connects the mouth holder therewith, an inner diameter of the first convex hole is smaller than that of the second convex hole.

2. The breathing airbag device, as recited in claim 1, wherein:

the nose holder, adapted for fittingly supporting a human nose and circulating air between the human nose and the filter airbag, comprises a nose holding body part, a nose holding connecting part and two nose holding undertaking parts;

the two nose holding undertaking parts are respectively located at two sides of the nose holding body part, the nose holding body part is fixed with the two nose holding undertaking parts via the nose holding connecting part, a nose holding convex hole is provided in a middle of the nose holding body part and protrudes towards a direction of a top surface of the nose holding body part for fittingly fixing the first convex hole of the inner holding stand, the nose holding connecting part is arched, a center position thereof is fixed to one end where a short axis of the nose holding convex hole is located, two ends thereof are respectively fixed to top ends of the two nose holding undertaking parts, the two nose holding undertaking parts are respectively correspondingly located at two sides of the nose holding body part, two convex legs are respectively located at a top end and a bottom end of each of the two nose holding undertaking parts, an elastic strap fixing hole is provided on every convex leg, one of the two elastic straps is fixed to two elastic strap fixing holes at the top ends of the two nose holding undertaking parts, the other of the two elastic straps is fixed to two elastic strap fixing holes at the bottom end of the two nose holding undertaking parts;

a mouth holding fixing hole, adapted for fittingly fixing the mouth holder, is provided in a middle of each of the two nose holding undertaking parts.

3. The breathing airbag device, as recited in claim 2, wherein:

the mouth holder, adapted for fittingly supporting a human mouth and circulating air between the human mouth and the filter airbag, comprises a mouth holding body part, and two mouth holding connecting parts respectively located at two sides of the mouth holding body part;

the mouth holding body part is oval, a mouth holding convex hole is provided in a middle thereof, the mouth holding convex hole is oval and protrudes towards a direction of a top surface of the mouth holding body part for fittingly fixing the second convex hole of the inner holding stand, the two mouth holding connecting parts are respectively located at two ends of a top surface at a direction of a long axis of the mouth holding body part, each of the two mouth holding connecting parts has a ladder bending structure, one end of each of the two mouth holding connecting parts extends outwardly, the other end thereof is located at the mouth holding body part;

a curved rod and a lug are located at the end of the mouth holding connecting part extending outwardly, the curved rod is adapted for fittingly fixing the mouth holding fixing hole of the nose holder and located at the top surface at the extending outwardly end of every mouth holding connecting part along a direction perpendicularly to the extending outwardly direction of every mouth holding connecting part;

the lug is located at the top surface at the extending outwardly end of every mouth holding connecting part along a direction opposite to the extending outwardly direction of every mouth holding connecting part.

4. The breathing airbag device, as recited in claim 3, wherein the nose holder and the mouth holder are made of soft rubber materials.

* * * * *